United States Patent [19]

Walbröhl

[11] 4,437,788

[45] Mar. 20, 1984

[54] METHOD AND APPARATUS FOR THE ADVANCING OF A SLIDING FORM

[76] Inventor: Heinz T. Walbröhl, Nordstrasse 75, Bonn 1, Fed. Rep. of Germany, 5300

[21] Appl. No.: 321,487

[22] Filed: Nov. 16, 1981

[30] Foreign Application Priority Data

Nov. 17, 1980 [DE] Fed. Rep. of Germany ..... 3043312

[51] Int. Cl.[3] ..... E21D 11/04

[52] U.S. Cl. ..... 405/146; 405/150; 405/141

[58] Field of Search ..... 405/146, 147, 142, 141, 405/143, 138, 150–153, 132

[56] References Cited

U.S. PATENT DOCUMENTS

| | | | |
|---|---|---|---|
| 3,350,889 | 11/1967 | Sturm | 405/143 |
| 3,410,098 | 11/1968 | Winberg | 405/147 |
| 3,434,294 | 3/1969 | Hall | 405/238 |
| 3,827,244 | 8/1974 | Walbrohl | 405/141 |
| 4,063,425 | 12/1977 | Jütte et al. | 405/147 |
| 4,122,683 | 10/1978 | Follert et al. | 405/142 |
| 4,139,989 | 2/1979 | Jones | 405/147 |
| 4,147,453 | 4/1979 | Unger et al. | 405/141 |

FOREIGN PATENT DOCUMENTS

| | | | |
|---|---|---|---|
| 774835 | 1/1968 | Canada | 405/146 |
| 2052605 | 1/1981 | United Kingdom | 405/146 |

*Primary Examiner*—Dennis L. Taylor

*Attorney, Agent, or Firm*—Anthony J. Casella; Gerald E. Hespos

[57] ABSTRACT

A method and apparatus for forming continuous concrete walls in tunnels or galleries is provided. More particularly, the invention relates to a form that is slidable through the gallery or tunnel. The form is an elongated supported tubular structure generally conforming to the shape of the gallery or tunnel. The outermost surface of the form is spaced from the wall of the gallery or tunnel a sufficient distance to enable an appropriate amount of concrete to be poured or pressed therein. The form is adapted to have the concrete pumped into the annular spaced provided for it, and to have the force of the concrete against the leading edge of the form cause the form to slidably advance through the gallery or tunnel.

22 Claims, 4 Drawing Figures

METHOD AND APPARATUS FOR THE ADVANCING OF A SLIDING FORM

The present invention relates to a method of advancing a sliding form for the lining of a gallery or tunnel in accordance with the manner set forth in the preamble to Claim 1, and to an apparatus for carrying out this method.

In the previously known methods of this type, a rigid formwork body, consisting of sheathing and stiffeners, is advanced by hydraulic presses which are supported against holding devices which are clamped in the already stripped concrete lining of the gallery or tunnel lying to the rear. In this connection it is desirable in principle to effect this advance of the sliding form as continuously as possible at a rate which is adapted to the rate of hardening of the concrete poured or pressed into the annular space between the working face of the tunnel or an outer form arranged there and the sheathing of the sliding form.

The front side of the said annular space is in this connection closed by an end form which forms a part of the sliding form and moves along generally with the sliding form but can, if necessary, be displaced by itself forward with respect to the rest of the sliding form for the introduction of reinforcements.

A continuously advancing sliding form must be of at least such an axial length that the in-situ concrete which comes out of the form at its rear end has reached sufficient strength to be able to take up the pressure of the surrounding earth exerted from the outside on it at least for a short time, i.e., until it is supported by a supporting form which is introduced behind the sliding form and remains in place until the concrete has reached it final load-carrying strength.

This means that the sliding form, which is advanced as a quasi single-piece member, must be moved forward, at least in its rear region, within a ring of in-situ concrete which surrounds it and which has already hardened to such an extent that it behaves as a non-elastic rigid body. Since the inside diameter or inside-dimension of this annular zone of rigid concrete is subject to certain production tolerances, high constraining forces may occur upon the advance of the sliding form since the concrete can no longer escape. These constraining forces can lead to cracks and fractures in the in-situ concrete. The same applies with respect to the constraining forces which occur when the sliding form, which is relatively long in axial direction, must be advanced through a section of a gallery or tunnel having a curved longitudinal axis.

These problems which occur already upon the continuous advance of the sliding form are further increased when there are iterruptions in or a stopping of the forward movement of the sliding form. In such case it may happen that the sliding form cannot be advanced further until the entire concrete resting on it has hardened approximately to such an extent that it is no longer capable of yielding plastically or elastically to the forces exerted by the sliding form when it is started up again, but on the other hand is not yet sufficiently hard, at least in its front parts, to take up the externally acting forces by itself. Removal of the sliding form in this state is therefore not permissible and in order to continue the concreting work it is necessary to place the sliding form again in motion from its existing position. In addition to the constraining forces which occur in this connection possibly over the entire length of the sliding form and are thus even greater, there are the adherence stresses which prevail between the hardened concrete and the form sheathing so that in these cases there is a greatly increased danger of the cracking or fracturing of the in-situ concrete.

In contradistinction to this, the object of the present invention is to provide a method of the aforementioned type, as well as an apparatus for the carrying out of this method, in which the danger of damage to the concrete lining the gallery or tunnel as a result of forces occurring between said concrete and the sliding form upon the forward movement of the sliding form is substantially reduced.

In order to achieve this purpose, the invention has the features set forth in claim 1 (method) and in claim 7 (apparatus).

By these measures the result is obtained that the formwork body can be supported rigidly at all places where it must be accurately positioned in order to obtain small production tolerances and therefore in the region where the in-situ concrete has just been introduced or is still liquid or only slightly hardened, so that even very high forces can be taken up here without any deviation in the position of the sheathing from the desired position. Constraining forces between concrete and sheathing cannot yet occur in these regions since the concrete is readily able to yield here.

On the other hand, in the regions in which the concrete has already hardened to such an extent that it cannot yield either plastically or elastically to the forces exerted by the sliding form upon its advance and in which therefore there is the danger of the cracking or fracturing of the concrete, the formwork body is so supported on the supporting structure by suitable supporting by means of elastic rather than rigid transmission members that, while it is still capable of taking up the high forces which are exerted on it by the concrete which is itself not yet capable of bearing load and by the earth surrounding said concrete, nevertheless, when these forces exceed a predetermined amount as a result of the occurrence of constraints or adherence stresses, it can yield elastically and can thus avoid an excessive stressing of the rigid concrete which is subject to fracturing.

Particular advantages of the method of the invention reside in the fact that it can be carried out at very little technical expense and that, due to the avoidance or substantial reduction of the constraining forces between concrete and sliding formwork body, passage through tunnel or gallery sections having a curved longitudinal axis is considerably facilitated.

The method of the invention can be used to advantage with two fundamentally different types of advance of the sliding form, namely both upon continuous advance and upon intermittent advance.

In the former case, as set forth in claim 2, the front parts of the formwork body which continuously travel along with the zone of the still liquid or not completely hardened concrete are supported practically continuously in rigid manner while the rear regions, which are continuously surrounded by a ring of concrete which has already hardened, rest continuously via the elastic transmission members on the supporting structure. Theoretically, one could therefore dispense here with the elastic transmisson members in the front region of the sliding form and with the rigid transmission members in the rear region. This, to be sure, would generally not be advisable since the possibility must always be taken into account that the sliding form will come to a stop for a substantial period of time and then must be started again, which then corresponds to intermittent advance.

In this second case, in accordance with claim 3, the entire sliding form can initially be rigidly supported; the transition to the elastic supporting takes place over the entire length of the sliding form, either simultaneously or gradually, when the concrete adjoining the corresponding regions has acquired sufficient strength.

In the regions in which the concrete has already solidified, transfer to the elastic support advantageously takes place at the latest, in accordance with claim 4, when the sliding form which up to then has been stationary is again to be placed in motion.

In accordance with claim 5, a good criterion for the switching from rigid to elastic support consists of the moment when the concrete has reached its so-called green strength in the region in question. The green strength is the strength at which the freshly poured roof, while it cannot yet in self-supporting manner take up the existing loads, is nevertheless sufficiently firm so that the sliding form can be pulled away for a short time and be replaced by a following supporting form.

In this stage it is also possible, in accordance with the invention, if the formwork body is subdivided in accordance with claim 11 into segments lying alongside of each other in peripheral direction, to remove some of these segments for a short time from the concrete and spray their back with a lubricant in order further to reduce the adherence stresses between sliding form and hardened concrete.

Another considerable danger of damage to the completely poured concrete lining of a gallery or tunnel occurs with the traditional method of advance for a sliding form as a result of the fact that the forces required for the advancing of the form are applied by hydraulic presses which rest against abutments which are held fast into the concrete lining which has just been completed. This anchoring is effected more or less intermittently so that very high reaction pressure must be taken up by the concrete lining at these places, and these pressures may lead to the cracking of or similar damage to the concrete.

In order to eliminate this risk, within the scope of the object forming the basis of the invention it is provided, in accordance with claim 6, that the sliding form be advanced by the pressure of the concrete which is introduced behind the end form. An abutment there is employed in this case the entire concrete lining which has already hardened and over which the reaction forces act in very uniformly distributed form so that the local pressure forces remain relatively low. Damage to the concrete lining which has already hardened is not possible with this manner of procedure.

One particular advantage of this type of advance is that it leads to an excellent, uniform compacting of the liquid concrete injected behind the end form.

In order that the pressure necessary to produce the advancing forces can build up behind the end form, a sealing device is provided, in accordance with claim 12, between the outer peripheral edge of the end form and the working face of the gallery or tunnel or an outer form arranged there, the sealing device consisting, in order to avoid a loss of pressure and excessive wear upon the continuous advance of the sliding form, in accordance with claim 13 of at least two sealing elements arranged one behind the other in the direction of advance, one of which is at all times pressed in non-displaceable manner against the working face and thereby deforms within the possibilities of its intrinsic elasticity due to the forward movement of the end form, while the other sealing element or elements move freely along with the end form without deforming. If the sealing element which is exerting the sealing function at the time is deformed to such an extent that, upon a substantial further relative movement between its radial inner side which is firmly attached to the end form and its radial outer side which is pressed firmly against the working face, it would start to rub with this outer side along the working face then the other or one of the other sealing elements which were not deformed up to that time will be pressed against the working face so as to take over the sealing function while the sealing element which was applied up to now is removed from the working face so that it can move back into its undeformed position.

Therefore, even with an end form which moves forward continuously with the entire sliding form, a pressure-tight closure can constantly be maintained for the annular space which is enclosed behind the end form between the working face and the sheathing of the sliding form without any sealing elements sliding along the working face or the outer form.

The sealing elements are advantageously formed by hoses whose longitudinal axis extends in the peripheral direction of the end form and which can be pressed by an increase in their internal pressure against the working face and withdrawn from the working face by a reduction in this inner pressure.

In order to assure over a large area between these hoses and both the peripheral edge of the end form and the working face, these hoses advantageously have a rectangular profile as seen in radial section.

It may be expressly pointed out that this type of advance of the sliding form can be used even if the formwork body of the sliding form cannot be supported both in rigid and in elastic manner on the supporting structure.

The invention will be described below with reference to the illustrative embodiments shown in the drawings, in which.

Figure 1:
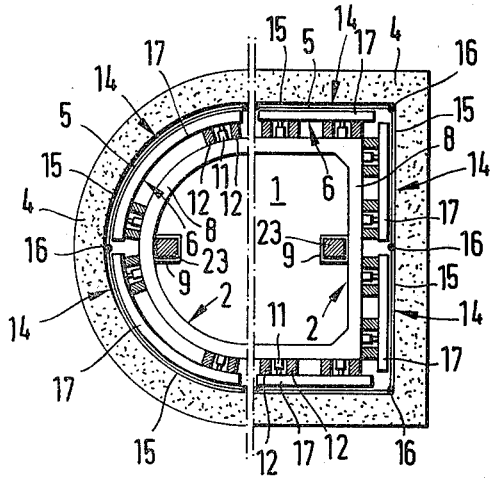
FIG. 1 shows diagrammatically in its left-hand half, a cross-section through a tunnel of circular profile and, in its right-hand half, a cross section through a tunnel of rectangular profile, a sliding form in accordance with the invention being arranged in each case within the tunnel.

In the case of the sliding form 2 arranged within a tunnel or gallery 1 as shown in FIG. 1, the actual formwork body consists of a sheathing 5 resting against the concrete 4 and stiffeners or form elements 6 which impart to the relatively thin sheathing, the stiffness necessary to take up the forces acting from the outside.

In order to support the formwork body formed of the sheathing 5 and stiffeners 6, a supporting structure 7 is provided within the gallery or tunnel, said structure being formed in the present example of individual annular supporting elements 8 which are spaced in lengthwise direction from each other and the shape of which is adapted in the transverse direction to the shape of the profile of the tunnel. In the lengthwise direction the supporting elements 8 are rigidly connected to each other by guide beams or longitudinal bars 9 which are developed as hollow profiles of rectangular inner cross-section.

The transmission of the forces exerted from the outside on the formwork body, consisting of sheathing 5 and stifferners 6, by the load of the concrete 4 and the earth surrounding it on the outside to the supporting elements 8 (sic), there are arranged in each case, between the stiffeners 6 and the supporting elements 8 at suitable points, groups of transmission members 11 and 12 respectively, each of these groups comprising at least one transmission member 11, which, in operation, rigidly transfers the forces from the corresponding stiffener 6 to the corresponding supporting element 8 and, parallel thereto, at least one transmission member 12 which transfers these forces elastically in operation.

Figure 2:
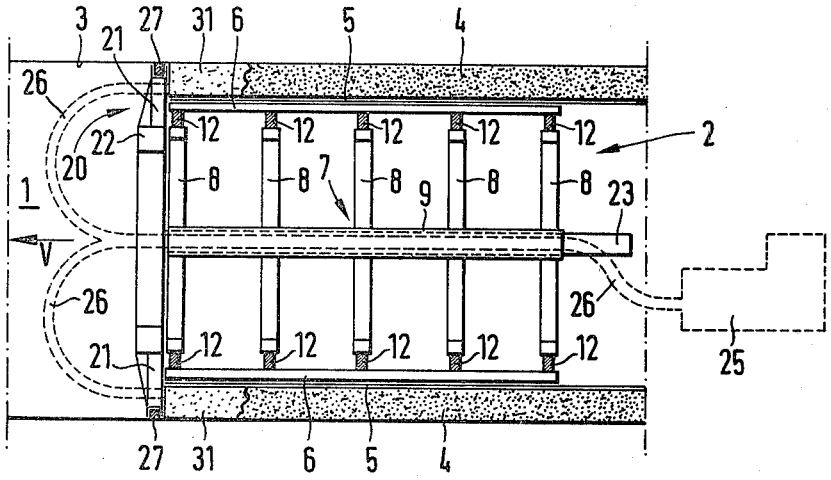
FIG. 2 is a longitudinal section through a gallery or tunnel with a sliding form in accordance with the invention.

In the embodiment shown in FIGS. 1 and 2, the rigid transmission members are formed by hydraulic pistons or presses 11 which, seen in the transverse direction of the tunnel, are arranged in each case between two rubber-metal ("silent") blocks 12 forming the elastic transmission members . In this case, the dimensions of the rubber-metal blocks 12 are such that the hydraulic pistons or presses 11 when in extracted position completely take over the supporting of the stiffeners 6 on the supporting elements 8 so that a rigid transmission of force is assured in this condition of operation.

By a pressure-control device, not shown in FIG. 1, the hydraulic pistons 11 can, however, be freed of pressure so that the rubber-metal blocks 12 arranged alongside of them elastically transfer the forces exerted on the formwork body by the concrete and the rock to the supporting elements 8.

The hydraulic pistons or presses 11 arranged on a supporting element 8 can be so connected to each other by a pressure conduit (not shown) that they can be placed simultaneously under pressure or freed of pressure. As alternative to this, the hydraulic presses or cylinders 11 of a supporting element 8 may be controllable individually or in groups.

The pressure condition of hydraulic pistons or presses 11 arranged on different supporting elements 8 is preferably controllable independently of each other.

As can further be noted from FIG. 1, both with a circular or rounded and with a polygonal cross section of the gallery or tunnel, the formwork body is subdivided in peripheral direction into individual segments 14. This means that, first of all, on the one hand the sheathing 5 consists, seen in peripheral direction, of individual form boards 15 which are arranged directly adjacent each other in peripheral direction. The gaps present between these individual form boards 15 are bridged by packings 16 of plastic or rubber whereby a certain relative mobility of the form boards with respect to each other is made possible. Furthermore, the stiffeners 6 also consist of stiffening elements 17 arranged individually alongside of each other in the peripheral direction of the tunnel, each stiffening element being associated with a form board 15.

In the example shown in FIG. 1, each stiffening element 17 is supported on a corresponding supporting element 8 via two groups of transmission members 11 and 12.

As can be noted in particular from FIG. 2, the annular hollow space enclosed between the tunnel or gallery working face 3 or an outer form and the sheathing 5 is closed at its front end by an end form 20 which consists of the actual formwork elements 21 and a ring construction 22 bearing said formwork elements. The end form ring 22 is connected via longitudinal girders 23 with the supporting structure 7 of the sliding form 2 consisting of the supporting elements 8 in the manner that the longitudinal girders 23 are guided displaceably in longitudinal direction in the longitudinal bars 9 of the supporting structure 7.

In general, the longitudinal girders 23 are in this case rigidly connected with the longitudinal bars 9 so that the entire sliding form can be advanced in the manner of a single-piece body.

Only for cases in which a partial section of the tunnel wall to be concreted is to be provided with reinforcements can the rigid connection between the end from 20 and the supporting structure 7 be disconnected and the end form 20 be advanced by itself with respect to the supporting structure 7 by means of pneumatic or hydraulic presses (not shown) acting between the longitudinal girders 23 and the longitudinal bars 9.

In all cases in which this is not necessary, the end form 20 and the supporting structure 7 remain firmly connected together. In this way it is possible to advance the entire sliding form by means of the pressure of the liquid concrete, which is injected by a concrete pump 25 via pressure conduits 26 from the end into the annular hollow space 31 enclosed between the tunnel inner wall 3 and the sheathing 5. In this case, the already hardened in-situ concrete 4 which substantially closes off the rear of this annular space serves as abutment.

This manner of advance is especially advantageous, in particular, because it makes it unnecessary to provide any abutments for the advance of the sliding form 2 within the completely concreted cross-section of the tunnel, thus avoiding the constriction in space inherent therein as well as the resultant danger of damage to the in-situ concrete which has already been completed. Furthermore, it is possible in this way to obtain an extremely good compressing or compacting of the liquid concrete which has been introduced fresh into the annular hollow space 31 between tunnel working face 3 and sheathing 5.

Figure 3:
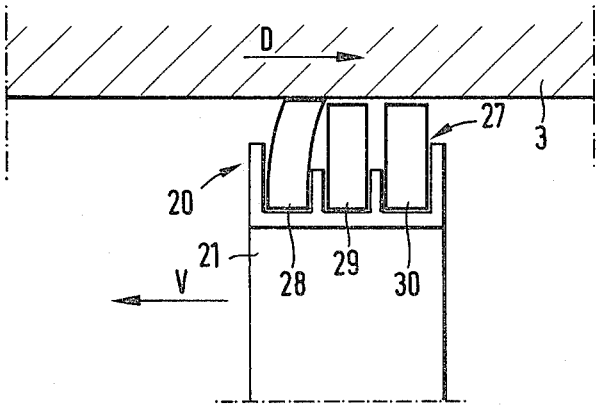
FIG. 3 shows a detail of FIG. 2, a cross-section extending in the same direction through a sealing device in accordance with the invention arranged on the peripheral edge of the end form being shown.

In FIG. 3, the sealing device 27 which was merely indicated in FIG. 2 is so shown on a larger scale that its construction in accordance with the invention becomes clear. The supporting of the formwork body, consisting of sheathing 5 and stiffeners 6, in accordance with the invention on the supporting elements 8 via rigid and elastic transmission members as defined, are hydraulic pistons 11 and rubber metal blocks 11 and 12 arranged parallel to each other and adapted to be placed alternately in operation can be effected not only independently of whether the advance of the sliding form 2 takes place continuously or intermittently but also independently of whether it is carried out, in known manner, with the aid of hydraulic or pneumatic presses which rest at the one end against abutments arranged in the tunnel which has been lined and on the other end against the supporting structure 7, or whether the advancing forces are produced in the manner particularly preferred in the invention by the pressure of the liquid concrete introduced behind the end form 20.

In the latter case it is important that—as shown in FIG. 3—a good seal be maintained between the working face 5 of the tunnel or gallery or the outer form arranged there and the peripheral edge of the end form 20. This seal, must, on the one hand, be sufficiently strong to permit the required build-up of pressure behind the end form 20 and on the other hand have the flexibility required in order to permit forward movement of the slide form 2 and at the same time assure compensation between the substantially rigid and invariable outer edge of the end form 20 and the inner contour of the working face 3 or of the outer form arranged there, which contour is not completely uniform due to manufacturing or operating tolerances.

In accordance with the invention there is employed for this purpose a sealing device 27 which comprises a first inflatable hose element 28 which extends in the peripheral direction of the end form 20 and is rectangular in the cross section shown in FIG. 3, it being rigidly connected in its radially inner region with the end form 20 and protruding in inflated condition via its radial outer edge to such an extent that its radial outer surface is pressed firmly against the working face 3 of the tunnel.

If now, upon the advance of the llining of the tunnel, the sliding form 2 and, with it, the end form 20 are advanced in the direction indicated by the arrow V, then, at least in the case of continuous advance, the hose element 28 must remain pressed against the working face 3 during the forward movement in order that the pressure which effects this forward movement be maintained behind the end form 20. This leads, first of all to the deformation of the hose element 28 shown in FIG. 3. In order that, upon further forward movement of the end form 20 in the direction indicated by the arrow V, the radially outer surface of the hose element 28 does not rub along the working face 3, which might lead to a loss of pressure behind the end from 20 and cause very strong wear of the hose element 28, at least one further hose element 29, in principle of precisely the same construction, is fastened on the peripheral edge of the end form 20 in axial direction alongside the first hose element 28, in accordance with the invention. This second hose element 29 remains without pressure and thus does not lie against the working face 3 as long as the first hose element 28 is under pressure and assures the required sealing function. Only when the first hose element 28 which is under pressure and therefore lies against the working face 3 has deformed to such an extent, as a result of the forward movement of the end form 20, that in the case of further forward movement of the end form it would start to rub along the working face 3, is the second hose element 29 placed under pressure so as to apply itself in sealing fashion against the working face 3. Thereupon the pressure in the first hose element 28 is decreased to such an extent that the element contracts in radial direction and comes free of the working face 3. Due to its elasticity, the deformation of the hose element 28 shown in FIG. 3 is thereby done away with and it again assumes its initial position, which is shown in FIG. 3 for the hose element 29, and, for a third hose element 30 arranged axially behind the hose element 29. Upon the further forward movement of the end form 20, the second hose element 29 which now rests against the working face 3 is deformed, in the manner shown in FIG. 3 for the hose element 28. When this deformation has advanced to such an extent that once again the sliding of the outer surface of the hose element 29 against the working face 3 could commence, the third hose element 30 is placed under pressure and now assumes the sealing function, while the hose element 29 is again relieved of pressure.

Thus, by an alternate placing under pressure, proceeding in the direction for the arrow D, i.e., opposite the direction of advance V, of the hose elements 28, 29 and 30 arranged on the peripheral edge of the end form 20, a continuously tight closure of the annular space enclosed between working face 3, end form 20 and sheathing 5 of the sliding form 2 can, even in case of continuous advance of the sliding form 2, be assured so as to maintain the drive pressure prevailing in said annular space without the sealing device 27 rubbing along the working face 3 of the tunnel or gallery.

In accordance with the invention, when employing this method of drive there must also be a pressure-tight connection between the end form 20 and the formwork body 5, 6 extending axially rearward from it. In accordance with the invention, the end form can also be subdivided into segments to which the concrete is fed separately. In this case, a separate pressure control can advantageously be provided for the hose elements of each segment in order to permit a certain directional control of the end form 20 when it is to be pushed forward, for instance, in a tunnel or gallery having a curved longitudinal axis.

Figure 4:
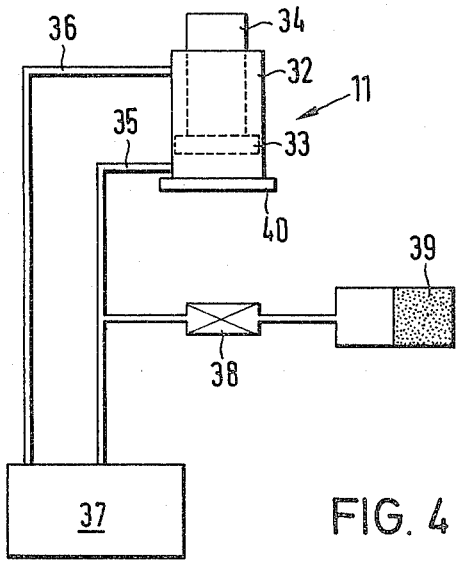
FIG. 4 shows another possible manner of developing the rigid and elastic transmission members in accordance with the invention.

FIG. 4 shows another possibility for the development, in accordance with the invention, of the rigid and elastic transmission members arranged between the formwork body 5, 6 and the supporting elements 8 of the support structure 7.

As can be noted from FIG. 4, the hydraulic press, 11 which forms a rigid transmission member, has a double-acting piston 33 which is movable back and forth in a cylinder and bears a ram 34 which and, for instance, be pressed against a stiffener 6 and withdrawn from it, while the cylinder 32 is connected to a base plate 40 which rests, for instance, on a supporting element 8. The inside of the cylinder 32 can be connected, either in front of or behind the piston 33, via conduits 35 and 36 respectively to a source of pressure 37 in order to press the ram 34 against the stiffener 6 or withdraw it from the stiffener. From the conduit 32 a branch extends over a shut-off valve 38 to a gas cushion 39, which can be provided, parallel to the hydraulic press 11, instead of or in addition to the rubber-metal blocks 12 shown in FIGS. 1 and 2 as elastic transmission member between the formwork body 5, 6 and the supporting structure 7. By means of the shut-off valve 38 it is possible to shut off the conduit extending from the hydraulic pump 37 to the gas cushion 39 and to build up in the hydraulic cylinder 32 the hydraulic pressure necessary for the rigid supporting of the formwork body 5, 6. If the shut-off valve 38 is then opened, an elastic support is assured by the connection to the gas cushion 39. By this arrangement the same pressure as in the case of the rigid support can be maintained even in the case of the elastic support, the essential difference being that, in the case of elastic support, forces exceeding this pressure, which are produced, for instance, in case of constraints occurring between sliding form 2 and hardened concrete 4 can be taken up by elastic deformations.

What is claimed is:

1. A method for advancing a sliding form upon the lining of a gallery or tunnel, which comprises a formwork body extending in the longitudinal direction of the gallery or tunnel and substantially parallel to its working face, an end form which closes off the front side of the annular space contained between the working face of the gallery or tunnel or an outer shell arranged there and the formwork body and a supporting structure which bears at least the formwork body, characterized by the fact that, at least in the region of the roof of the gallery or tunnel, the parts of the formwork body which are filled at the back with liquid concrete and the parts of the formwork body which rest against concrete which has not yet hardened, are rigidly supported on the supporting structure and that, after sufficient hardening of the concrete, transfer is effected to an elastic supporting of the formwork body on the supporting structure.

2. A method according to claim 1 in which the sliding form is advanced continuously at a rate which is adapted to the rate of hardening of the concrete, characterized by the fact that the front parts of the formwork body, in the region of the concrete which is still liquid or has not yet sufficiently hardened, are supported rigidly on the supporting structure while the rear parts of the formwork body in the region of the sufficiently hardened concrete are supported elastically on the supporting structure.

3. A method according to claim 1 in which the sliding form is advanced intermittently, characterized by the fact that for the parts of the formwork body which are initially rigidly supported transfer is effected to elastic support after a sufficient hardening of the concrete resting against said parts.

4. A method according to claim 3, characterized by the fact that the transfer to elastic support is effected at the lastest before the advancing again of a sliding form which has been temporarily stopped.

5. A method according to any of the claims 1, 2, 3, or 4, characterized by the fact that the transfer form the rigid support to the elastic support takes place when the concrete resting on the corresponding parts of the formwork body has reached its so-called green strength.

6. A method according to claim 1 characterized by the fact that the sliding form is moved forward with the aid of the pressure of the concrete forced into the part of the annular space present behind the end form.

7. An apparatus according to claim 6, characterized by the fact that the rigid transmission members are hydraulic presses.

8. An apparatus according to claim 7, characterized by the fact that the elastic transmission members are formed of rubber-metal blocks.

9. An apparatus according to any of claims 7 or 8, characterized by the fact that the elastic transmission members comprise pneumatically or hydraulically appliable cushions.

10. An apparatus according to claim 1 characterized by the fact that the framework body is divided into individual segments lying alongside each other in peripheral direction, the gaps between which are bridged by sealing elements which permit a certain relative movement of the individual segments.

11. An apparatus according to claim 10 characterized by the fact that a sealing device is provided between the outer edge of the end form and the working face of the gallery or tunnel or of an outer form arranged there.

12. An apparatus according to claim 11, characterized by the fact that the sealing device consists of at least two hoses which are arranged one behind the other in the direction of advance, extend in the peripheral direction of the end form and rest, in non-inflated condition, displaceably against the working face or the outer form and, in inflated condition, firmly against the working face or the other form, and by the fact that said hoses can be individually inflated and deflated.

13. An apparatus according to claim 12, characterized by the fact that each of the hoses has an approximately rectangular cross-sectional profile.

14. An apparatus according to claims 12 or 13, characterized by the fact that three hoses are arranged one behind the other, as seen in the direction of advance.

15. An apparatus according to any one of claims 11, 12 or 13, characterized by the fact that the end form is divided into segments to each of which the liquid concrete can be fed separately.

16. An apparatus according to claim 15, characterized by the fact that the hoses of each segment of the end form can be acted on by pressure and deflated independently of the hoses of all other segments of the end form in order to control the direction of the sliding form.

17. An apparatus according to any one of claims 11, 12 or 13, characterized by the fact that the end form is tightly and firmly but detachably connected to the formwork body.

18. An apparatus for advancing a sliding form upon the lining of a gallery or tunnel, said apparatus comprising a formwork body extending in the longitudinal direction of the gallery or tunnel and substantially parallel to its working face, and end form which closes off the front side of the annular space contained between the working face of the gallery or tunnel or an outer shell arranged there and the formwork body, a supporting structure which bears at least the formwork body, at least one group of rigid and elastic transmission members with the transmission members in each grop being aligned generally parallel to each other and disposed on the supporting structure and intermediate the supporting structure and the formwork body, and a switching device operative to optionally place in operation either the rigid transmission members or the elastic transmission members for transmitting forces between the supporting structure and the formwork body, whereby the sliding form is moved forward with the aid of pressure of concrete forced into the part of the annular space behind the end form.

19. An apparatus according to claim 14, characterized by the fact that the end form is divided into segments to each of which the liquid concrete can be fed separately.

20. An apparatus according to claim 14, characterized by the fact that the end form is tightly and firmly but detachably connected to the formwork body.

21. An apparatus according to claim 15, characterized by the fact that the end form is tightly and firmly but detachably connected to the formwork body.

22. An apparatus according to claim 9, characterized by the fact that the elastic transmission members comprise pneumatically or hydraulically appliable cushions.

* * * * *